US008657374B2

(12) United States Patent
Higgs

(10) Patent No.: US 8,657,374 B2
(45) Date of Patent: Feb. 25, 2014

(54) CHAIR

(76) Inventor: Thomas Oliver Duncan Higgs, London (GB)

( * ) Notice: Subject to any disclaimer, the term of this patent is extended or adjusted under 35 U.S.C. 154(b) by 547 days.

(21) Appl. No.: 12/999,317

(22) PCT Filed: Jun. 17, 2009

(86) PCT No.: PCT/GB2009/001514
§ 371 (c)(1),
(2), (4) Date: Dec. 16, 2010

(87) PCT Pub. No.: WO2009/153556
PCT Pub. Date: Dec. 23, 2009

(65) Prior Publication Data

US 2011/0089730 A1 Apr. 21, 2011

(30) Foreign Application Priority Data

Jun. 12, 2009 (GB) ..... 0910097.5

(51) Int. Cl.
*A47C 3/04* (2006.01)

(52) U.S. Cl.
USPC ..... 297/239; 297/294; 297/451.2; 297/451.8; 297/440.13; 297/248

(58) Field of Classification Search
USPC ..... 297/239, 325, 314, 451.2, 294, 451.4, 297/451.8, 440.14, 195.13, 195.12, 196, 297/198, 452.39
See application file for complete search history.

(56) References Cited

U.S. PATENT DOCUMENTS

| | | | | | |
|---|---|---|---|---|---|
| 78,531 | A | * | 6/1868 | Ludlow | 297/314 |
| 100,083 | A | * | 2/1870 | Stephan | 297/196 |
| 114,376 | A | * | 5/1871 | White | 297/302.7 |
| 1,978,024 | A | | 10/1930 | Lorenz | |
| 1,964,424 | A | * | 6/1934 | Borah | 297/302.1 |
| 1,998,508 | A | * | 4/1935 | Kappenberg | 248/629 |
| 2,068,996 | A | * | 1/1937 | Smith | 188/129 |
| 2,266,092 | A | * | 12/1941 | Springer | 297/303.1 |
| 2,309,881 | A | * | 2/1943 | Wise | 297/296 |
| 2,489,981 | A | * | 11/1949 | Rose | 248/582 |
| 2,534,386 | A | * | 12/1950 | Stewart | 248/371 |

(Continued)

FOREIGN PATENT DOCUMENTS

| | | |
|---|---|---|
| AU | 718284 | 8/1997 |
| AU | 20040100725 | 9/2004 |

(Continued)

*Primary Examiner* — David E Allred
(74) *Attorney, Agent, or Firm* — James Creighton Wray

(57) ABSTRACT

There is provided a chair (101) comprising: a seating portion (102) for occupation; a base portion (103) for location upon a support surface; and a connecting portion (104) connectedly extending between said seating portion (102) and said base portion (103); wherein said connecting portion (104) is configured to provide a degree of freedom of the position of said seating portion (101) relative to said base portion (103), such that said seating portion (102) is movable between a default unloaded position relative to said base portion (103) and each of a plurality of available loaded positions relative to said base portion (103), whereby when unoccupied, said seating portion (102) is in said default unloaded position relative to said base portion (103), and when occupied, said seating portion (102) is in one of said plurality of available loaded positions relative to said base portion (103), whereby said chair is configured to dynamically respond to changes in the posture of an occupant.

14 Claims, 5 Drawing Sheets

(56) References Cited

U.S. PATENT DOCUMENTS

| | | | | | |
|---|---|---|---|---|---|
| 2,537,071 | A | * | 1/1951 | Lukins | 297/294 |
| 2,637,371 | A | * | 5/1953 | Boutin | 297/294 |
| 2,715,938 | A | * | 8/1955 | Miller | 248/565 |
| 2,874,755 | A | * | 2/1959 | Smith | 297/183.1 |
| 2,949,153 | A | * | 8/1960 | Hickman | 248/585 |
| 2,967,565 | A | * | 1/1961 | Schultz | 297/239 |
| 3,041,109 | A | * | 6/1962 | Eames et al. | 297/451.4 |
| 3,774,960 | A | * | 11/1973 | Blodee | 297/239 |
| 4,079,929 | A | * | 3/1978 | Varnum | 472/99 |
| 4,208,072 | A | * | 6/1980 | Iskendarian | 297/440.1 |
| 4,618,185 | A | * | 10/1986 | Kaufman | 297/285 |
| 4,787,672 | A | * | 11/1988 | Werner | 297/296 |
| 4,976,494 | A | * | 12/1990 | Polley | 297/464 |
| 5,242,211 | A | * | 9/1993 | Grad et al. | 297/239 |
| 5,435,620 | A | | 7/1995 | Cheng | |
| 5,505,521 | A | * | 4/1996 | Meiller et al. | 297/302.1 |
| 5,573,304 | A | * | 11/1996 | Glockl | 297/314 |
| 5,782,532 | A | * | 7/1998 | Opsvik | 297/338 |
| 5,954,396 | A | | 9/1999 | Kemnitzer | |
| 6,056,362 | A | * | 5/2000 | de la Haye | 297/314 |
| 6,866,340 | B1 | * | 3/2005 | Robertshaw | 297/312 |
| 6,997,511 | B2 | * | 2/2006 | Marchand et al. | 297/314 |
| 7,063,386 | B2 | * | 6/2006 | Dowty et al. | 297/338 |
| 7,065,805 | B1 | * | 6/2006 | Sundberg | 4/572.1 |
| 7,338,125 | B2 | * | 3/2008 | Grabowski | 297/313 |
| 7,934,773 | B2 | * | 5/2011 | Boulais et al. | 297/325 |
| 8,061,767 | B2 | * | 11/2011 | Kunzler et al. | 297/201 |
| 8,256,845 | B2 | * | 9/2012 | Wang | 297/446.1 |
| 2003/0234566 | A1 | | 12/2003 | Vanderminden | |
| 2006/0232109 | A1 | * | 10/2006 | Olano | 297/195.11 |

FOREIGN PATENT DOCUMENTS

| | | | | | |
|---|---|---|---|---|---|
| DE | 3340131 | A1 | * | 5/1985 | A47C 3/023 |
| DE | 3421550 | A1 | * | 12/1985 | A47C 3/02 |
| DE | 29620099 | | | 9/1997 | |
| EP | 0087594 | | | 9/1983 | |
| EP | 0482728 | | | 4/1992 | |
| FR | 1145841 | | | 10/1957 | |
| WO | 2008034529 | | | 9/2007 | |

* cited by examiner

CHAIR

CROSS REFERENCE TO RELATED APPLICATIONS

This application claims priority from United Kingdom Patent Application No. 08 10 985.2, filed 17 Jun. 2008, and from United Kingdom Patent Application No. 09 10 097.5, filed 12 Jun. 2009, and the entire disclosure of each is incorporated herein by reference in their entirety.

TECHNICAL FIELD

The present invention relates to a chair.

BACKGROUND OF THE INVENTION

Static chairs are known. Static seating restricts movement and can have a detrimental effect on the body when used for extensive periods of time. Other chairs that have been designed to combat this issue have involved highly complex mechanisms and have not achieved the desirable level of fluidity of movement and responsiveness for this application.

BRIEF SUMMARY OF THE INVENTION

According to an aspect of the present invention, there is provided a chair comprising: a seating portion for occupation; a base portion for location upon a support surface; and a connecting portion connectedly extending between the seating portion and the base portion. The connecting portion is configured to provide a degree of freedom of the position of the seating portion relative to the base portion, such that the seating portion is movable between a default unloaded position relative to the base portion and each of a plurality of available loaded positions relative to the base portion. When unoccupied, the seating portion is in the default unloaded position relative to the base portion, and when occupied, the seating portion is in one of the plurality of available loaded positions relative to the base portion. The chair is configured to dynamically respond to changes in the posture of an occupant.

DESCRIPTION OF THE BEST MODE FOR CARRYING OUT THE INVENTION

FIG. 1

Figure 1:
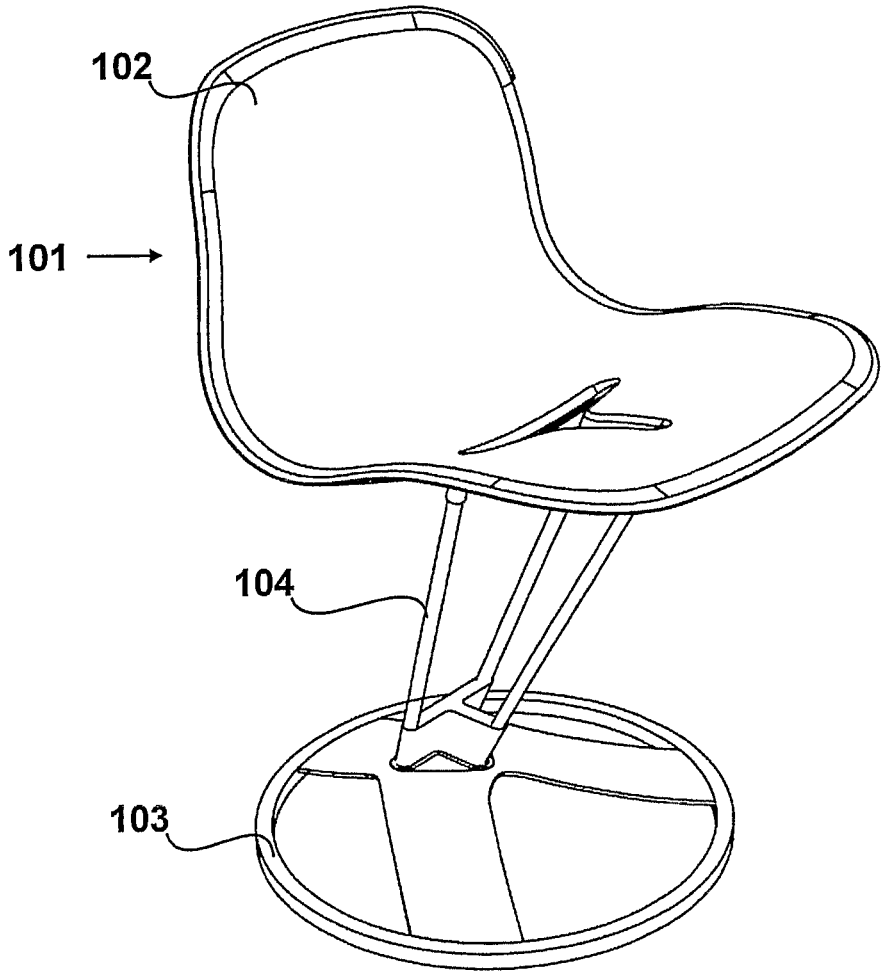
FIG. 1 shows a first view of a chair according to the present invention.
Figure 5:
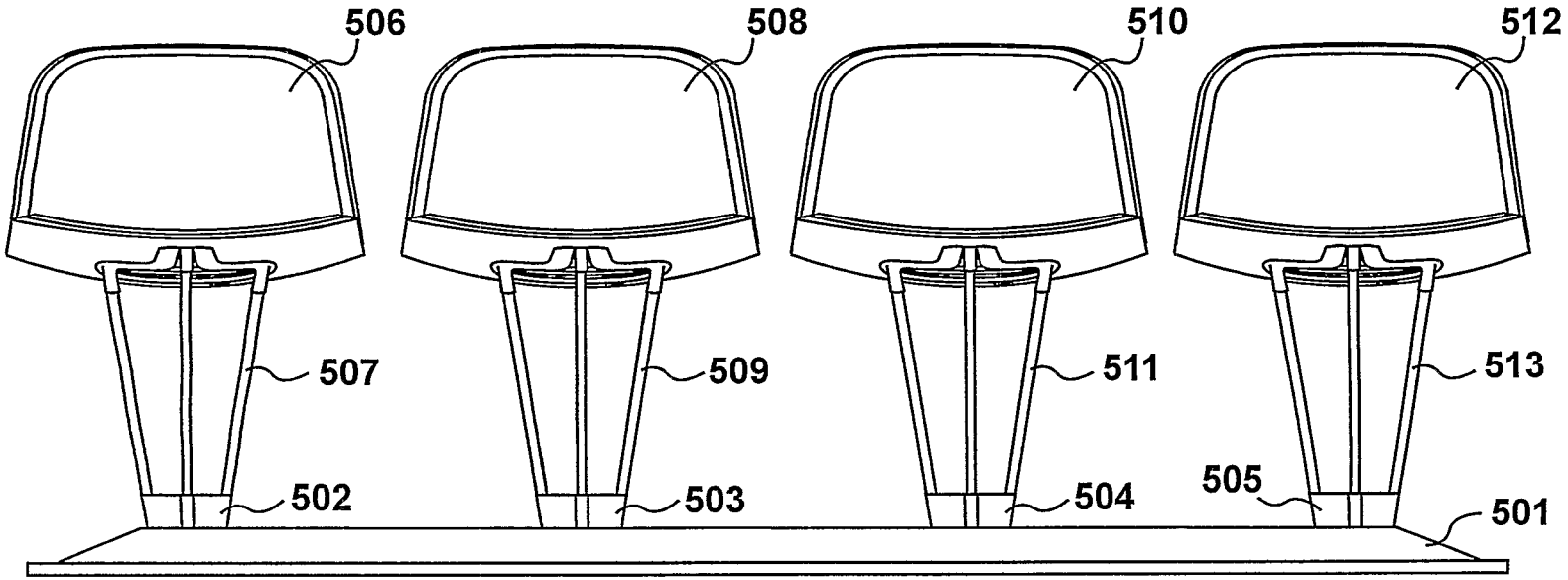
FIG. 5 shows a bench configuration of chairs according to the present invention.

A first view of a chair 101 is shown in FIG. 1. Chair 101 comprises seating portion 102, base portion 103 and connecting portion 104. Seating portion 102 is for occupation and in this embodiment is made from moulded plastic and any suitably shaped component could be used. Base portion 103 is in this embodiment substantially circular and is provided to locate the chair on a support surface such as a floor. In alternative embodiments differing base portions could be used provided that they offer a suitable degree of stability to the chair, for example a different configuration is shown in FIG. 5.

Connecting portion 104 connectedly extends between seating portion 102 and base portion 103. In this embodiment, connecting portion 104 comprises a plurality of elongate members. In this example, there are three elongate members although alternative numbers could be used in alternative configurations. In this embodiment, the elongate members are constructed from resilient material, in this example reinforced plastic. Suitable materials include GRP (Glass-Fibre Reinforced Plastic) or CRP (Carbon-Fibre Reinforced Plastic). Any other materials that share similar strength, flex and material memory properties are suitable.

The connecting portion 104 is configured to provide a degree of freedom of the position of the seating portion 102 relative to the base portion 103. This means that the seating portion 102 is moveable between different positions relative to the base portion depending upon whether the chair is occupied and the chair is configured to dynamically respond to changes in posture of an occupant. When it is unoccupied, the seating portion 102 is in a default unloaded position relative to base portion 103. When the chair is occupied, the seating portion is moveable between a plurality of available loaded positions relative to the base portion. Because of the configuration of the connecting portion 104, the relative positions of seating portion 102 and base portion 103 are able to adjust in response to movements of the occupant. Therefore, the chair provides an active seating solution in contrast with other chairs, which are static. In addition, in the present embodiment the connecting portion 104 is configured to return to the default unloaded position as an occupant vacates the chair.

FIG. 2

Figure 2:
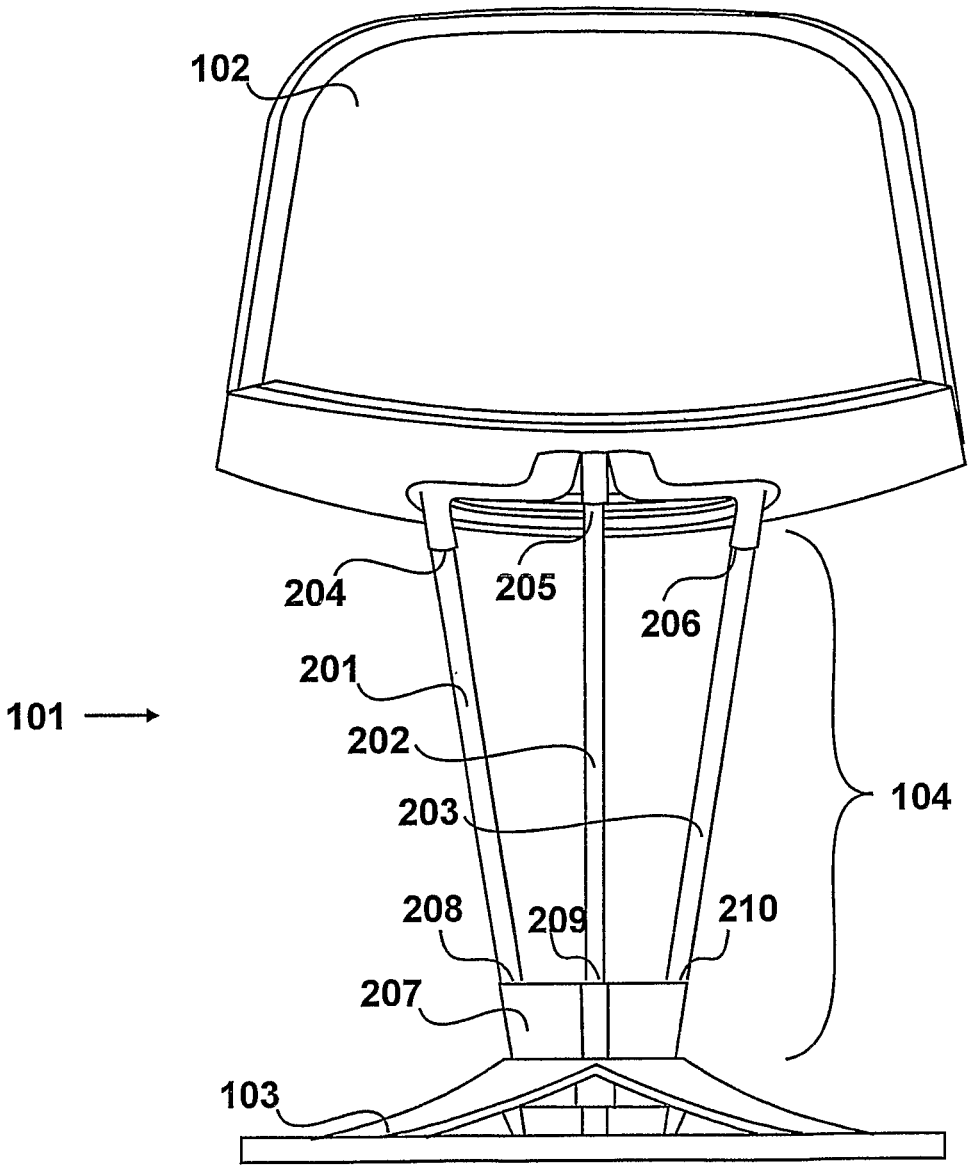
FIG. 2 shows a front view of a chair according to the present invention.

A front view of chair 101 is shown in FIG. 2. Again seating portion 102 and base portion 103 can be seen along with connecting portion 104 which comprises a plurality of elongate members. In this example there are three elongate members labelled as rod 201, rod 202 and rod 203. Rod 201 is attached to seating portion 102 at point 204, rod 202 is attached to seating portion 102 at 205 and rod 203 is attached to seating portion 102 at 206. These attachment points 204, 205 and 206 are substantially in front of the centre of gravity of the load when the chair is occupied.

In addition, there is provided a wedge portion 207. Rod 201 is attached to wedge portion 207 at 208, rod 202 is attached to rod portion 207 at 209, and rod 203 is attached to wedge portion 207 at 210. In this configuration rods 201, 202 and 203 are in a tapered position such that attachment points 204, 205 and 206 which join with seating portion 102 are relatively far from one another in comparison with attachment points 208, 209 and 210 which join wedge portion 207 which in turn connects with base portion 103.

In this example wedge portion 207 is attached to rods 201, 202 and 203 and is removably attached to base portion 103. Wedge portion 207 is configured to receive rods 201, 202 and 203 in a substantially T-shaped configuration and thus the cross-section of wedge portion 207 is substantially a T-shape.

In the present example, the central rod 202 is at a shallower angle than outer rods 201 and 203. In alternative embodiments more elongate members may be provided in addition to those shown in this example.

In this example the rods 201, 202 and 203 taper from the seating portion 102 to the base portion 103 at an angle of approximately 9°. The provision of the wedge portion 207 makes the chair more stable and also provides for stacking as is further described with reference to FIG. 4.

FIG. 3

Figure 3:
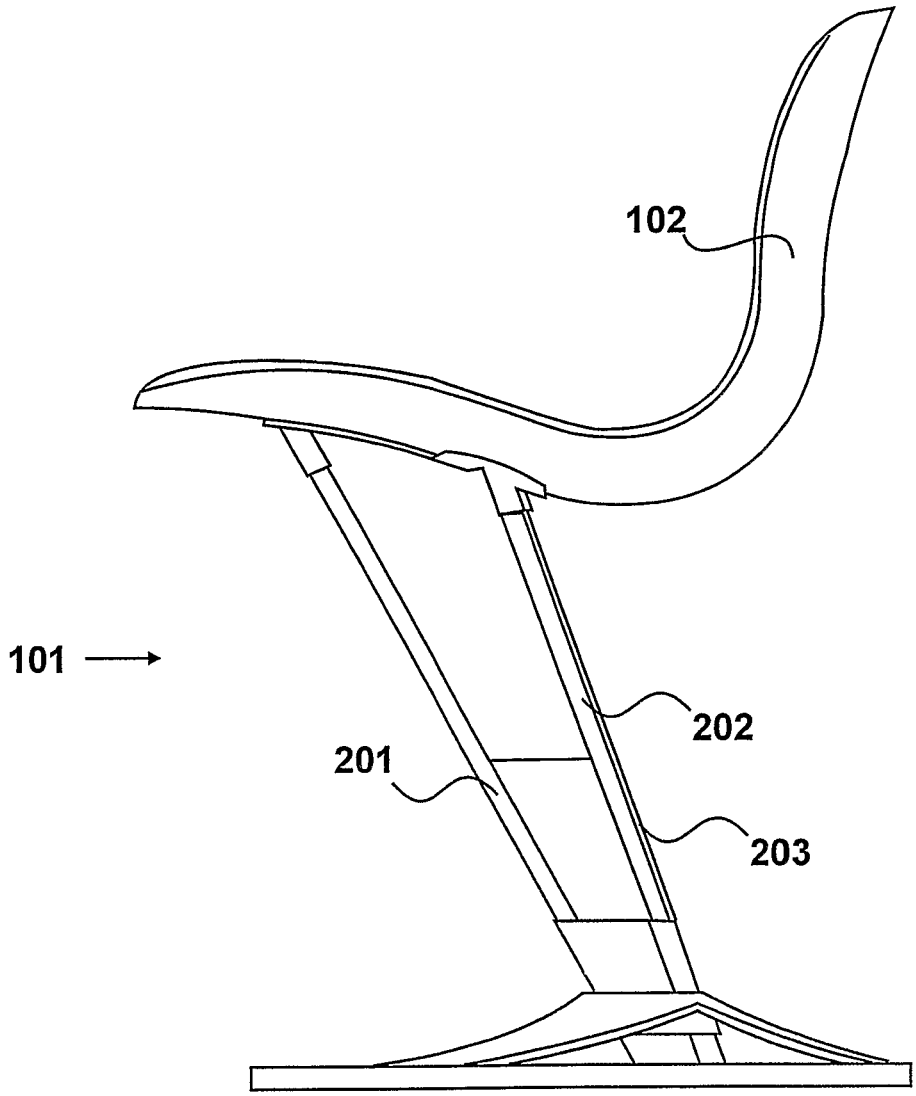
FIG. 3 shows a side view of a chair according to the present invention.

A side view of chair 101 is shown in FIG. 3, it can be seen in this Figure that central rod 201 is at a shallower angle than outer rods 202 and 203. In addition it is apparent that all three rods are attached to seating portion 102 at points substantially in front of the centre of gravity of the load of the chair when the chair is occupied.

When the chair is occupied and the rods 201, 202 and 203 are bearing a load, the rods deform into an inherent S-bend. If the load is greater on one side the chair will tilt and pivot with the load to support the new position. The resilience of the rods provides this adjustment and allows seating portion 102 to return to its default position when the chair is unoccupied.

FIG. 4

Figure 4:
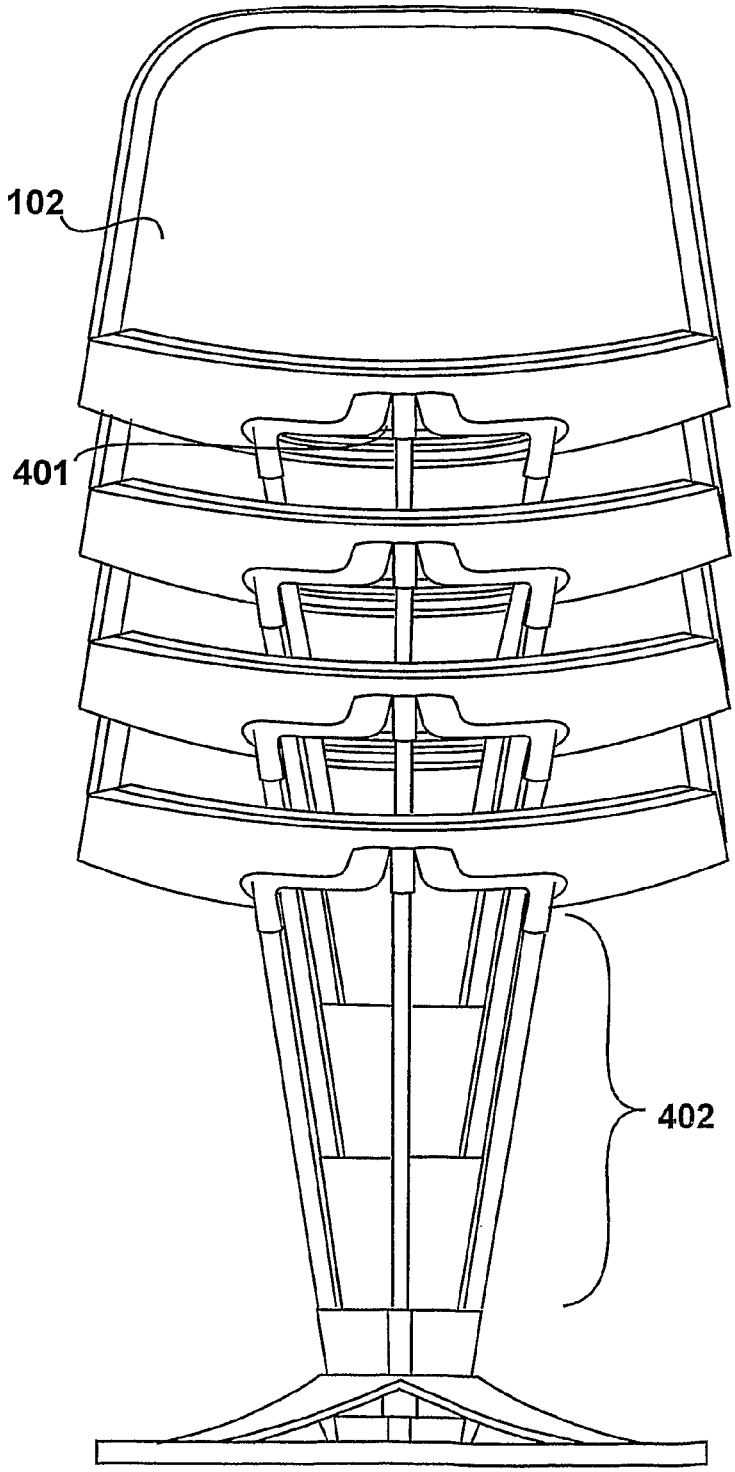
FIG. 4 shows a plurality of chairs according to the present invention in a stacked configuration.

A plurality of chairs according to an embodiment of the present invention are shown stacked in FIG. 4. In this configuration, in order to stack the chairs a first chair is placed on a support surface and subsequent chairs have the wedge portion 207 removed from base portion 103 in order to stack then. The surplus base portions can in this example be stacked separately. Each chair in this example has an opening as is shown at 401 in FIG. 4 in seat portion 102. Seating portion 102 defines this opening in order to allow a connecting portion of another similar chair to pass through it in order to stack the chairs. In this example opening 401 is substantially T-shaped in order to allow the previously described three-rod configuration of the connecting portion to pass through. In alternative embodiments with alternatively arranged connecting portions the opening 401 would be adjusted accordingly. The wedge portions stack into one another as is shown at 402.

The tapered configuration of the rods provides for stacking in this type of arrangement and also increases stability of the chair.

FIG. 5

An example of a bench-style configuration of chairs according to the present invention is shown in FIG. 5. In this embodiment, instead of there being provided a single base portion as shown at 103 in earlier Figures there is provided a bench base at 501. Bench-style base portion 501 is configured to receive a plurality of wedge portions, shown here as 502, 503, 504 and 505 each supporting their own seating portion. Thus, seating portion 506 is supported by connecting portion 507 and wedge portion 502, seating portion 508 is supported by connecting portion 509 and wedge portion 503, seating portion 510 is supported by connecting portion 511 and wedge portion 504 and seating portion 512 is supported by connecting portion 513 and wedge portion 505. Advantages to the bench-type configuration include the facility to move a plurality of seating portions at the same time and the ease with which a uniform seating configuration may be achieved. Stacking is also facilitated in the bench-style configuration by seating portions and connecting portions being stacked into each other with the bench-style bases being stacked separately.

The invention claimed is:

1. A chair comprising:

a generally one-piece seating portion for occupation having a front and a rear in a position of use;

a base portion for location upon a support surface when supporting the seating portion in the position of use; and a connecting portion, comprising at least three elongate members each connected directly to an underside of said seating portion and extending downward and to the rear between said seating portion and said base portion to provide the position of use and the connecting portion configured to deform on application of a load on the seating portion in the position of use, and where a laterally central elongate member of the at least three elongate members is at a shallower angle relative to the horizontal than a plurality of outer elongate members of the at least three elongate members, and wherein said outward elongate members are connected to the seating portion rearwardly of the connection of the laterally central elongate member to the seating portion in the position of use; wherein:

when unoccupied, said seating portion in the position of use is in a default unloaded position relative to said base portion, and when occupied by an occupant, said seating portion in the position of use is in one of a plurality of available loaded positions relative to said base portion, wherein the particular loaded position is defined by the degree to which each of said plurality of elongate members has deformed.

2. A chair according to claim 1, wherein said seating portion is configured to return to said default unloaded position as said occupant vacates said chair.

3. A chair according to claim 1, wherein the positions of a plurality of outer elongate members are divergently sloped outwardly and upwardly such that upper ends of the elongate members are attached to said seating portion at locations relatively far from one another and lower ends of the elongate members are attached to said base portion at locations relatively close to one another.

4. A chair according to claim 1, wherein said elongate members are constructed from resilient material.

5. A chair according to claim 4, wherein said resilient material is reinforced plastic.

6. A chair according to claim 1, wherein said seat portion is formed by moulding.

7. A chair according to claim 1, wherein said connecting portion is removable from said base portion.

8. A chair according to claim 7, wherein said seating portion defines an opening configured to allow a connecting portion of another similar chair to pass through it in order to stack said chairs.

9. A chair according to claim 8, wherein said opening is substantially T-shaped.

10. A chair according to claim 1, wherein said elongate members are configured to be attached to a wedge member which is attachable to said base portion.

11. A chair according to claim 10, wherein said wedge member is substantially T-shaped.

12. A chair according to claim 1, wherein said base portion is substantially circular.

13. A chair according to claim 1, wherein said elongate members are attached to a part of said seating portion at points adjacent to the front of the seating portion.

14. A chair according to claim 1, wherein the base portion is configured to receive a plurality of seating portions and their respective connecting portions.

* * * * *